United States Patent [19]

Smith

[11] 3,949,350

[45] Apr. 6, 1976

[54] ORNAMENTAL LIGHTING DEVICE

[76] Inventor: Richard D. Smith, 1416 Hermosa Ave., Hermosa Beach, Calif. 90254

[22] Filed: Aug. 7, 1974

[21] Appl. No.: 495,321

[52] U.S. Cl. ..... 240/10 R; 84/464; 240/2 G

[51] Int. Cl.[2] ..... F21P 1/02

[58] Field of Search ..... 240/2 R, 2 G, 2 L, 1 R, 240/10 R, 10 A, 10.1; 84/464

[56] References Cited

UNITED STATES PATENTS

| | | | |
|---|---|---|---|
| 3,062,085 | 11/1962 | Smith | 240/10.1 X |
| 3,205,755 | 9/1965 | Sklar | 240/10 R |
| 3,538,323 | 11/1970 | Ziegler | 240/10.1 |
| 3,540,343 | 11/1970 | Rifkin | 86/464 |
| 3,598,889 | 8/1971 | Switsen | 86/464 X |
| 3,634,679 | 1/1972 | Krzyston | 240/10.1 |
| 3,798,638 | 3/1974 | Goldschmied | 86/464 X |

*Primary Examiner*—R. Moses

*Attorney, Agent, or Firm*—Herzig & Walsh, Inc.

[57] ABSTRACT

First and second groups of light bulbs of different colors are disposed on base structure within a first light transmitting enclosure. The first enclosure is preferably a prismatic dome shaped lens which operates to project images of the bulb filaments. A circuit arrangement is provided for detecting, amplifying and separating an audio signal into bass and treble audio tones. The light bulbs are connected to the circuit arrangement so that one group is driven in response to the bass tones, while the other group is driven in response to the treble tones. A second light transmitting enclosure may be mounted on the base to surround the first enclosure. The second enclosure is preferably translucent to provide a surface upon which the colors of the bulbs and the images of their filaments are projected and displayed.

5 Claims, 5 Drawing Figures

ORNAMENTAL LIGHTING DEVICE

BACKGROUND OF THE INVENTION

The present invention relates to decorative and ornamental lighting devices.

Heretofore, lighting devices for providing ornamental and decorative displays have been devised. Set out below are a list of U.S. Patents believed to be representative of the prior art.

| PATENT NO. | INVENTOR | DATE PATENTED |
|---|---|---|
| 1,195,659 | Court, et al. | 22 Aug. 1916 |
| 1,671,071 | Gritt | 22 May 1928 |
| 1,843,897 | Gritt | 2 Feb 1932 |
| 1,854,418 | Morrison | 19 Apr 1932 |
| 1,918,123 | Newman | 11 Jul 1933 |
| 1,928,329 | Coffin | 26 Sep 1933 |
| 3,056,019 | Apatoff, et al. | 25 Sep 1962 |
| 3,235,722 | Burnbaum | 15 Feb 1966 |
| 3,531,636 | Birch | 29 Sep 1970 |

SUMMARY OF THE INVENTION

It is an object of the present invention to provide an improved ornamental and decorative lighting device.

In accomplishing these and other objects, there is provided in accordance with the present invention first and second groups of light bulbs of different colors disposed on base structure within a first light transmitting enclosure. The first enclosure is preferably a prismatic dome shaped lens which operates to project images of the bulb filaments. A circuit arrangement is provided for detecting, amplifying, and separating an audio signal into bass and treble audio tones. The light bulbs are connected to the circuit arrangement so that one group is driven in response to the bass tones while the other group is driven in response to the treble tones. A second light transmitting enclosure may be mounted on the base to surround the first enclosure. The second enclosure is preferably translucent to provide a surface upon which the colors of the bulbs and the images of their filaments are projected and displayed.

Additional objects of the present invention reside in the specific embodiment of lighting device illustrated in the drawings and hereinafter described in conjunction therewith.

DETAILED DESCRIPTION OF THE PREFERRED EMBODIMENT

Figure 1:
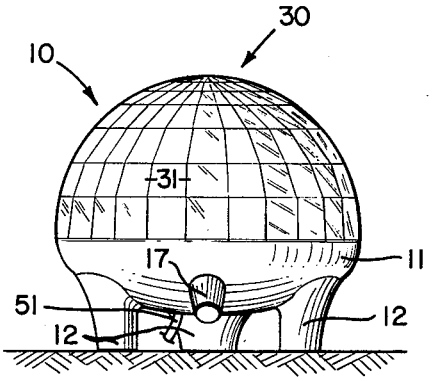
FIG. 1 is a side elevation view of an ornamental lighting device according to the present invention.
Figure 2:
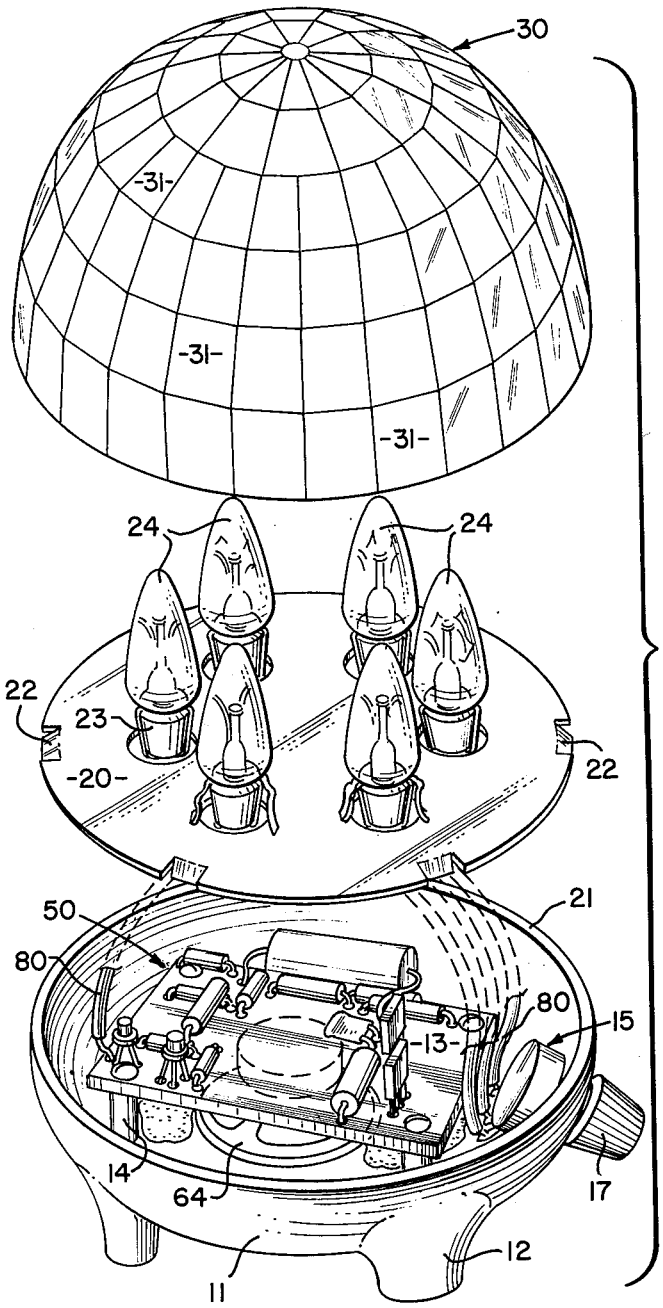
FIG. 2 is an exploded perspective view of the device of FIG. 1.

Referring to the drawings in more detail, there is shown in FIG. 1 a lighting device generally identified by the numeral 10. As shown in FIGS. 1 and 2, the device 10 has a base 11 formed as an upwardly opening bowl on legs 12. The base 11 has an electrical circuit board 13 mounted therein on leg-like supports 14. The circuitry mounted on the board 13 is hereinafter described in connection with FIG. 3 and is selectively operated through the on-off switch 15. The switch 15 is mounted on the base 11 with its shaft 16 extending through the wall of the bowl 11 so that the device 10 may be switched on and off by turning the knob 17.

Fitted on the top of the base 11 is a lamp socket support plate 20. The support plate 20 is designed to rest upon the upper edge 21 of the base 11 and has downwardly bent flanges 22 which fit within the wall of the base 11 to hold the plate 20 centered thereon. Formed on the upper surface of the plate 20 are a plurality of lamp or bulb sockets 23, six of which are illustrated, having bulbs 24 placed therein. As illustrated, the bulbs or lamps 24 may be candle shaped and the sockets 23 may be positioned to define a circle concentric with the vertical axis of the base structure 11. The bulbs 24 are selected to be of different colors and to be transparent so that their filaments are visible.

Figure 4:
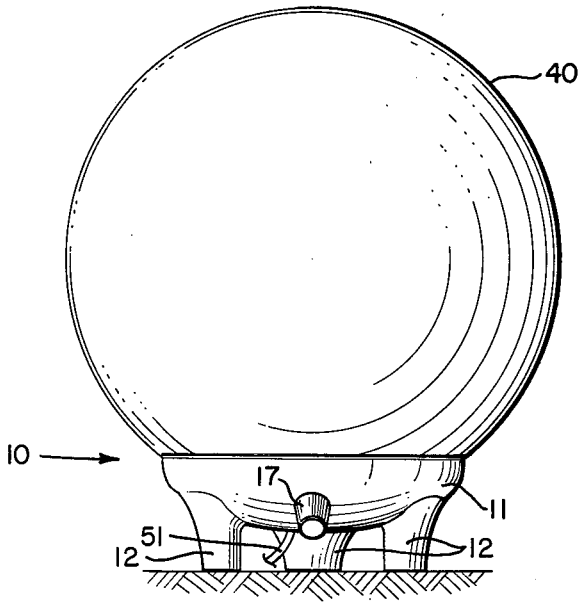
FIG. 4 is a side elevation view of the device of FIG. 1 having a translucent globe mounted thereon to provide a translucent display surface.
Figure 5:
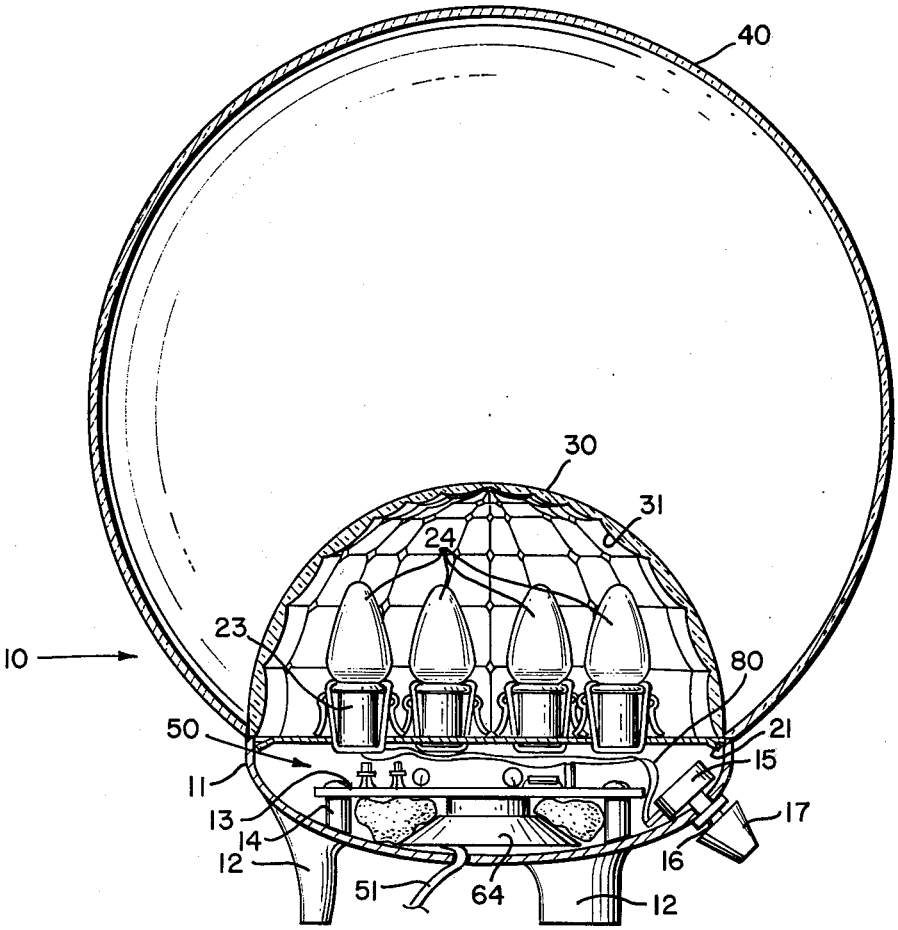
FIG. 5 is a cross-sectional side elevation view of the device as shown in FIG. 4.

Mounted on the base structure 11 is a transparent prismatic dome shaped lens 30 which encloses the lamps 24. As shown in FIG. 5, the lens 30 is formed by plurality of lens surfaces 31 which are flat on their outer side and convex shaped on their inwardly facing side. The lens surfaces 31 operate to project the different colored lights of the bulbs 24 and their filaments. As shown in FIGS. 4 and 5, a second light transmitting enclosure 40 may be mounted on the base 11. The second enclosure 40 is illustrated as a translucent globe and as hereinafter explained operates to provide a display surface.

Figure 3:
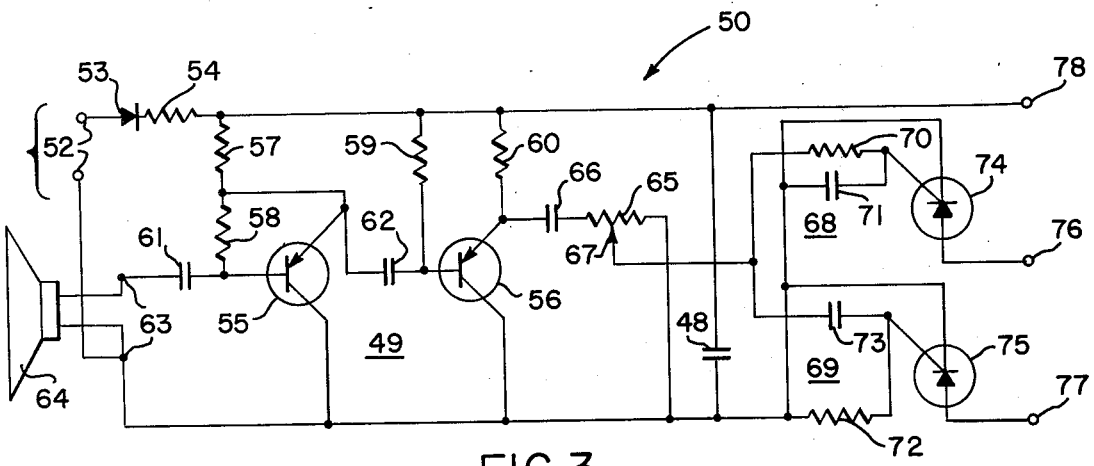
FIG. 3 is a schematic diagram of the electrical circuitry of the device of FIG. 1.

The electrical circuitry of the device 10 is shown schematically in FIG. 3 and is generally identified by the numeral 50, the circuit arrangement 50, when electrical cord 51 is plugged into a household electrical outlet, receives 120 volt 60 Hertz power on terminal 52. This AC power is rectified and filtered by the arrangement of the capacitor 48, diode 52 and resistor 53 to supply DC power to the two stage audio amplifier 49 formed by the PNP transistors 55–56, the biasing resistors 57-60 and the DC blocking capacitors 61–62.

The two stage transistor amplifier 49 has input terminals 63 which are connected to receive an audio signal. The terminals 63 are illustrated connected to an audio microphone 64 although the amplifier 49 and device 10 could be driven by the output of a stereo reproducer or any other suitable device.

In response to an audio signal detected by the microphone 64, the amplifier 49 amplifies the signal to produce an amplified audio output across load resistor 65. The resistor 65 is connected in series with the blocking capacitor 66 and has a voltage pickoff 67. Connected to receive the voltage output generated on the pickoff 67 are a bass filter 68 and a treble filter 69. The bass filter 68 is formed by a resistor 70 and capacitor 71 which may have the respective values of 47 kiloohms and 0.005 farads. The treble filter is formed by a resistor 72 and capacitor 73. A suitable set of values for the resistor 72 and capacitor 73 is, respectively, 22 kiloohms and 0.005 farads.

The filters 68 and 69 are connected, respectively, to the control electrodes of the silicon controlled rectifiers (SCR) 74 and 75 for controlling their conduction. The anode electrodes of the SCRs 74 and 75 are commonly connected to one side of the storage capacitor 48 while their cathode electrodes are connected, respectively, to the output terminals 76 and 77. A third output terminal 78 is connected to the other side of the storage capacitor 48. Electrical leads 80, shown in FIG. 2, connect the terminals 76-78 through the switch 15 to the lamp sockets 23. The output terminal 78 is commonly connected to one electrical terminal of all the sockets 23. The other electrical terminals of half the sockets 23 are connected to the terminal 76 while the other electrical terminals of the remaining half of the sockets 23 are connected to the output terminal 77. Thereby, the bulbs 24 in the sockets 23 are divided into first and second lamp groups which illuminate, respectively, in response to conduction of the SCR 74 and the SCR 75.

To operate the device 10, the electrical cord 51 is plugged into an electrical outlet to supply electrical power to the circuitry 50. The knob 17 is then turned to the on position to connect the first and second lamp groups, respectively, between terminals 78–76 and 78–77.

In operation, the device 10 functions in the following manner. Audio sounds near the device 10 are picked up by the microphone 64, amplified by the transistor amplifier 49 and divided by the filters 68, 69 into bass and treble channels. The bass signal detected by filter 68 triggers the SCR 74 into conduction. Thereby, the group of colored lamps 24 associated with the SCR 74 are driven as a function of the bass tones in the audio signal picked up by the microphone 64. In a corresponding manner, the treble signal detected by the filter 69 triggers the SCR 75 into conduction to drive the colored lamps 24 associated with the SCR 75 as a function of the treble tones in the audio signal detected by the microphone 64. It is noted that the colors of the bulbs 24 associated with the bass tones are selected to be distinctly different from those associated with the treble tones. Thereby, the device 10 may be arranged to generate so called "hot" colors in response to bass tones, and "cool" colors in response to treble tones, or vice versa.

With the translucent globe 40 removed, the colored lights from the bulbs 24 and their respective filaments magnified are projected by the dome lens 30 onto the ceiling and walls of a room in which the device 10 is positioned.

With the translucent globe 40 placed over the lens 30 as shown in FIGS. 4–5, when the colored lamps 24 are activated, their colors and the images of their filaments are projected and thereby displayed on the translucent surface of the globe 40.

It is noted that the light transmitting enclosure provided by the globe 40 may be formed in any suitable shape and may be a frosted polyethylene material.

Although I have herein shown and described my invention in what I have conceived to be the most practical and preferred embodiment, it is recognized that departures may be made therefrom within the scope of my invention.

I claim:

1. An ornamental lighting apparatus, comprising:

base structure;

circuit means mounted within said base structure and responsive to an audio signal for generating first and second output signals corresponding, respectively, to the bass and treble tones of the audio signal to which said circuit means is responding;

first and second differently colored lamp means mounted on said base structure and connected to said circuit means, said first lamp means being responsive to said first output signal to illuminate as a function thereof and said second lamp means being responsive to said second output signal to illuminute as a function thereof;

first light transmitting enclosure means mounted on said base structure to enclose said first and second lamp means whereby the colored light radiated from said lamp means is transmitted by said first enclosure means to generate an ornamental display of colored light, said first enclosure means being a domeshaped prismatic lens means, second light transmitting enclosure means mounted on said base structure enclosing said first enclosure means, said second enclosure means being translucent and being in the form of a globe providing a display surface for light transmitted from said lens means, said lens means having a plurality of lens surfaces which are flat on their outer sides and convex on their inwardly facing sides, the prismatic lens means being positioned to extend into the first enclosure means.

2. The invention defined in claim 1, wherein:

said first and second lamps means include colored light bulbs having visible filaments; and said first enclosure means is constructed to project the images of the filaments of said bulbs.

3. The invention defined in claim 2, said second enclosure means being constructed whereby the images of said bulb filaments are projected and thereby displayed on the surface of said second enclosure means.

4. The invention defined in claim 1, wherein said circuit means comprises:

microphone means for picking up ambient audio signals;

amplifier means connected to said microphone means for amplifying said sudio signals; and filter means connected to said amplifier means for generating from said amplified audio signals said first and second output signals.

5. The invention defined in claim 4, wherein said circuit means and lamp means include first and second silicon controlled rectifiers which are triggered into conduction in response to, respectively, said first and second output signals, said first and second lamp means being energized whenever said first and second silicon controlled rectifiers, respectively, are triggered into conduction.

* * * * *